US006041680A

United States Patent [19]

Wang

[11] Patent Number: 6,041,680

[45] Date of Patent: Mar. 28, 2000

[54] PINCERS

[76] Inventor: Yen-Yu Wang, P.O. Box 2103, Taichung, Taiwan

[21] Appl. No.: 09/198,260

[22] Filed: Nov. 24, 1998

[51] Int. Cl.[7] ..... B25B 7/04

[52] U.S. Cl. ..... 81/409; 81/407

[58] Field of Search ..... 81/91.1, 91.2, 81/318–320, 324, 355, 356, 362, 363, 405, 407, 409

[56] References Cited

U.S. PATENT DOCUMENTS 5,644,960 7/1997 O'Brien ..... 81/363

5,970,827 10/1999 Lin ..... 81/409

*Primary Examiner*—James G. Smith
*Assistant Examiner*—David B Thomas

[57] ABSTRACT

A pincers including a fixed component, a movable component and a locating mechanism. The fixed component is formed with an elliptic moving recess. A moving member is synchronously moved when a pushing rod of the movable component moves within a slide slot formed in the moving recess. The locating mechanism serves to restrict the moving of the moving member and restrict the moving of the pushing rod so as to fix the distance between the fixed jaw and movable jaw and pitchlessly adjust the pincers.

6 Claims, 10 Drawing Sheets

PINCERS

BACKGROUND OF THE INVENTION

The present invention relates to a pincers, and more particularly to a pincers in which the gap between the fixed jaw and movable jaw can be adjusted pitchlessly. In addition, after adjusted, the gap between the fixed jaw and movable jaw can be fixed.

FIG. 9 shows an existing pincers including a first component 81 and a second component 82 having a fixing member 83. The first component 81 is formed with a first slide slot 84 within which the fixing member 83 of the second component 82 is slidable. After deflecting the fixing member 83, the engaging teeth 85 of the fixing member 83 are engaged with the insertion teeth 86 of the first slide slot 84, enabling the jaws 87 of the first and second components 81, 82 to tightly clamp a work piece. However, the engaging teeth 85 of the fixing member 83 and the insertion teeth 86 of the first slide slot 84 both have pitches. Therefore, pitches exist in the engagement between the teeth 85, 86 so that the clamping position of the jaws 87 is restricted. This leads to inconvenience in use of the pincers.

FIG. 10 shows another type of pincers in which one end of a movable handle 91 is pivotally connected with one end of a linkage 92. The other end of the linkage 92 extends into a fixed handle 93 to connect with a wedge block 94 slidable within the fixed handle 93. In addition, a stopper block 95 with a slope stopping face is disposed in the fixed handle 93. The size of the opening between the fixed jaw 96 and the movable jaw 97 is adjusted by means of changing the position of the stopper block 95. When gripping the movable handle 91, the three pivot points among the movable jaw 97, movable handle 91, the linkage 92 and the wedge block 94 are on the same straight line to achieve an elbow effect so as to tightly clamp a work piece between the fixed jaw 96 and the movable jaw 97. However, the stopper block 95 and inner wall of the fixed handle 93 of such pincers exert a reaction force onto the wedge block 94. Therefore, the movable handle 91 is subject to a resistant force against the application force. As a result, it is more strength-consuming to use such pincers.

SUMMARY OF THE INVENTION

It is therefore a primary object of the present invention to provide a pincers in which a fixed component is formed with an elliptic moving recess. A moving member is synchronously moved when a pushing rod of the movable component moves within a slide slot formed in the moving recess. The locating mechanism serves to restrict the moving of the moving member and restrict the moving of the pushing rod so as to fix the distance between the fixed jaw and movable jaw and pitchlessly adjust the pincers.

The present invention can be best understood through the following description and accompanying drawings, wherein:

DETAILED DESCRIPTION OF THE PREFERRED EMBODIMENTS

Figure 1:
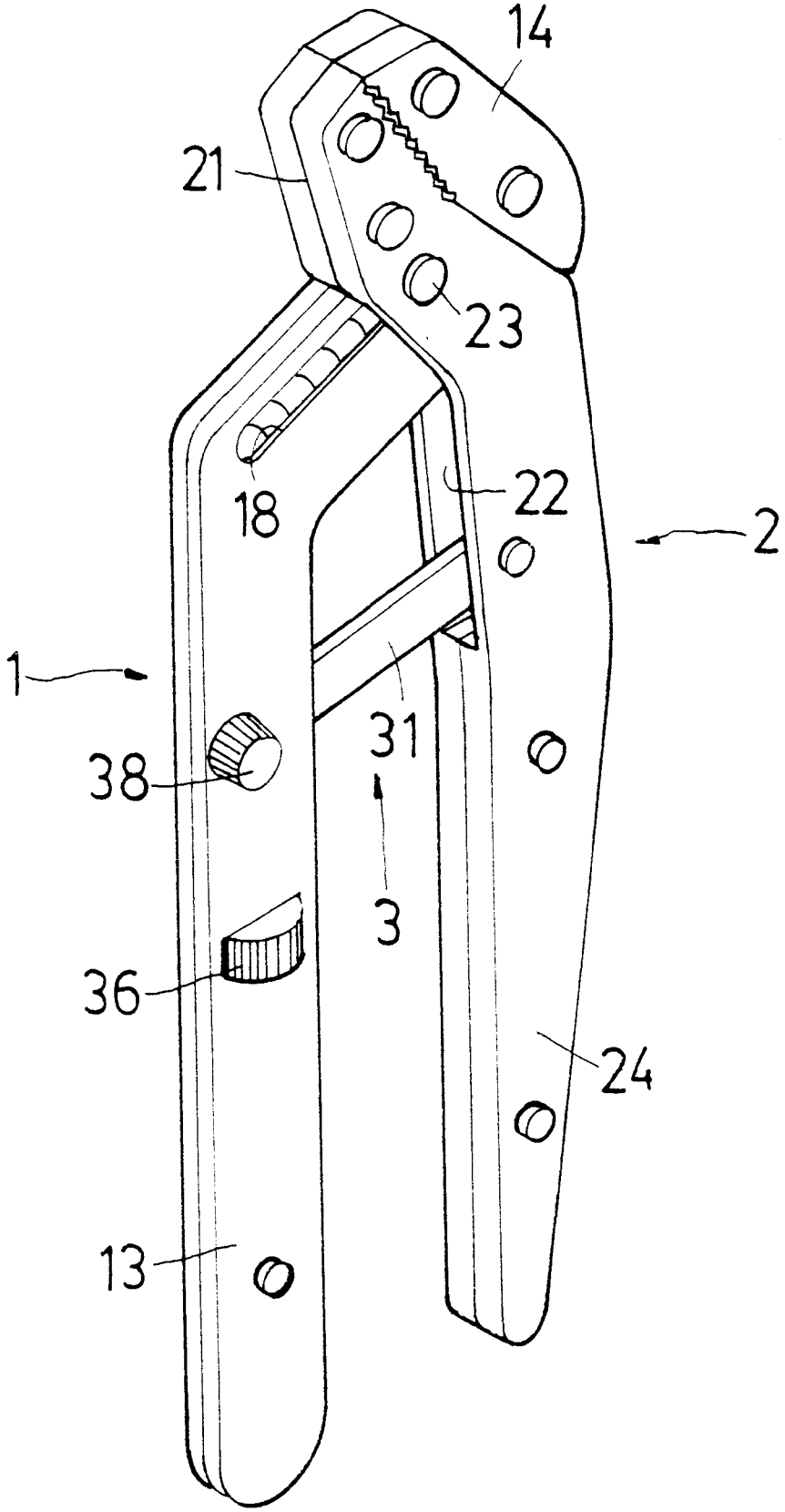
FIG. 1 is a perspective assembled view of a first embodiment of the present invention.
Figure 2:
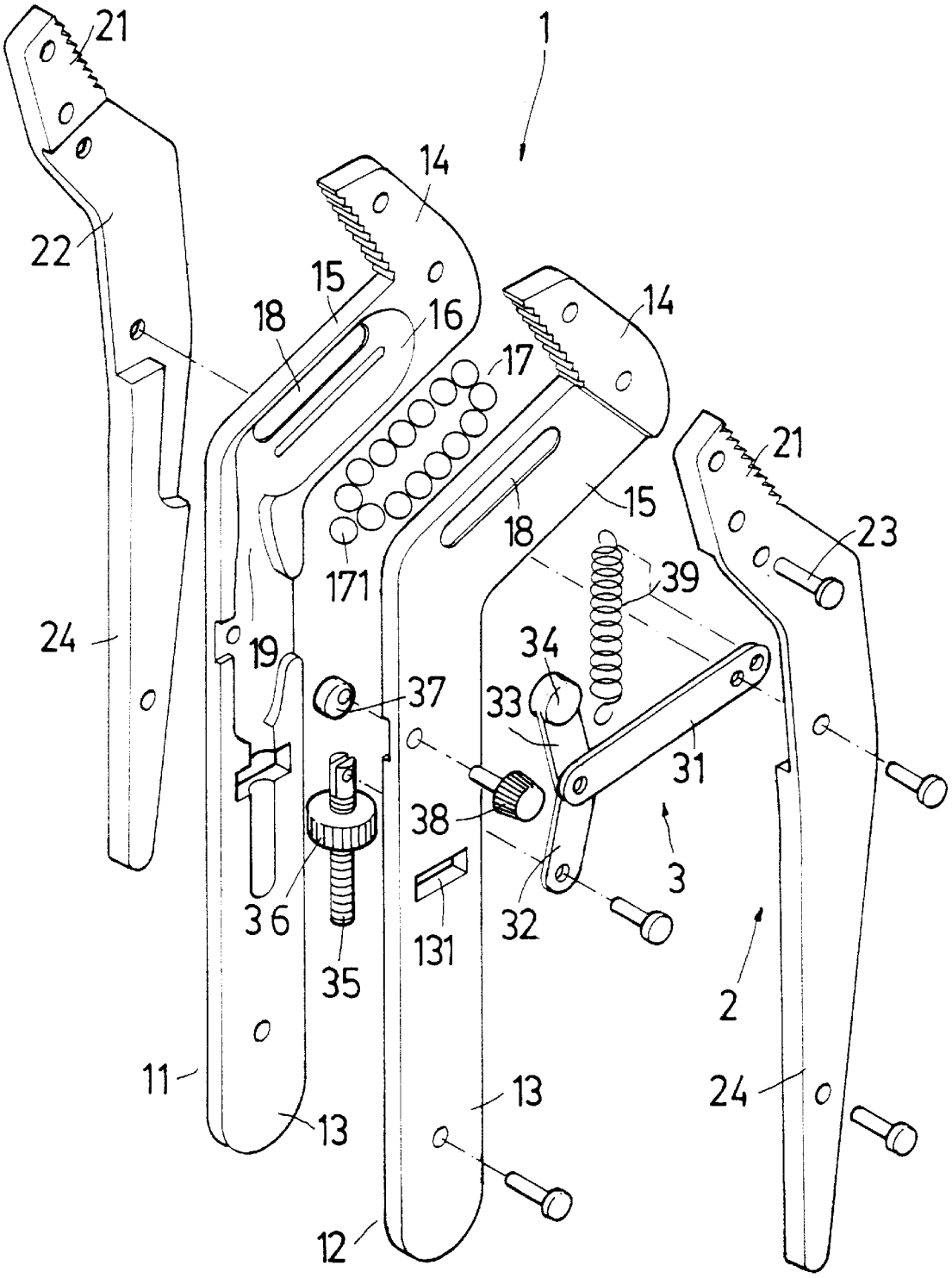
FIG. 2 is a perspective disassembled view of the first embodiment of the present invention.

Please refer to FIGS. 1 to 5. According to a first embodiment of the present invention, the pincers is a tube vice including:

a fixed component 1 composed of a first and a second panels 11, 12, a lower end of the fixed component 1 being disposed with a fixed handle 13, a middle section of the fixed handle 13 being formed with an adjustment hole 131 passing through two lateral faces thereof, an upper end of the fixed component 1 being disposed with a fixed jaw 14 connected to the fixed handle 13 by an interconnecting section 15, the inner faces of the first and second panels 11, 12 at the interconnecting section 15 being respectively formed with two close elliptic moving recesses 16 opposite to each other, a moving member 17 composed of multiple rolling balls 171 being disposed in the moving recess 16, an upper section of each moving recess 16 being formed with a slide slot 18 with the same inclination angle as that of the interconnecting section 15, a receptacle 19 downward extending from the bottom of the upper section of the moving recess 16;

a movable component 2 composed of two panels, an upper end of the movable component 2 being disposed with a movable jaw 21 abutting against the fixed jaw 14 of the fixed component 1, the bottom of the movable jaw 21 being formed with a passage 22 through which the interconnecting section 15 of the fixed component 1 is passed, the movable component 2 at the passage 22 being disposed with a pushing rod 23 passing through the slide slot 18 of the interconnecting section 15 and positioned between two adjacent rolling balls 171, a lower section of the movable component 2 being disposed with a movable handle 24; and a locating mechanism which in this embodiment is an elbow mechanism 3 disposed between the fixed handle 13 and the movable handle 24. The elbow mechanism 3 includes a first lever 31 one end of which is pivotally connected with the movable handle 24. This end is connected with an upper end of a spring 39. A lower end of the spring 39 is connected with the movable handle 24. The other end of the first lever 31 is pivotally connected with an upper end of a second lever 32 and a lower end of a third lever 33. A lower end of the second lever 32 is connected with a thread rod 35. An adjustment switch 36 is disposed on the thread rod 35 in the adjustment hole 131 of the fixed handle 13. The upper end of the third lever 33 is connected with an engaging member 34 disposed in the receptacle 19. The elbow mechanism 3 further includes a cam 37 disposed on one side of the fixed handle 13 distal from the first lever 31. The cam 37 is connected with a rotary switch 38 disposed on outer side of the fixed handle 13. An eccentrical section of the cam 37 abuts against a pivot section of the second and third levers 32, 33, whereby the second and third levers 32, 33 are not positioned in one straight line.

Figure 3:
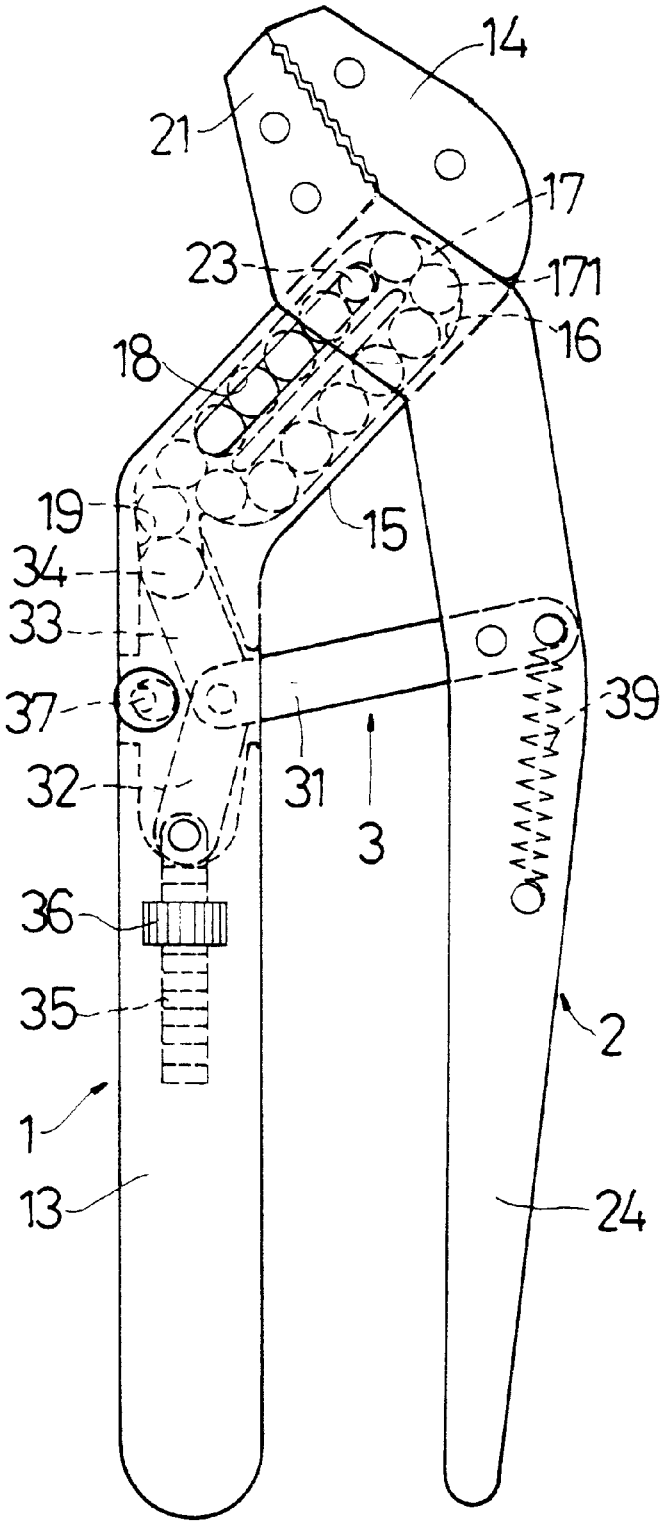
FIG. 3 is a side view of the first embodiment in a not opened state.
Figure 4:
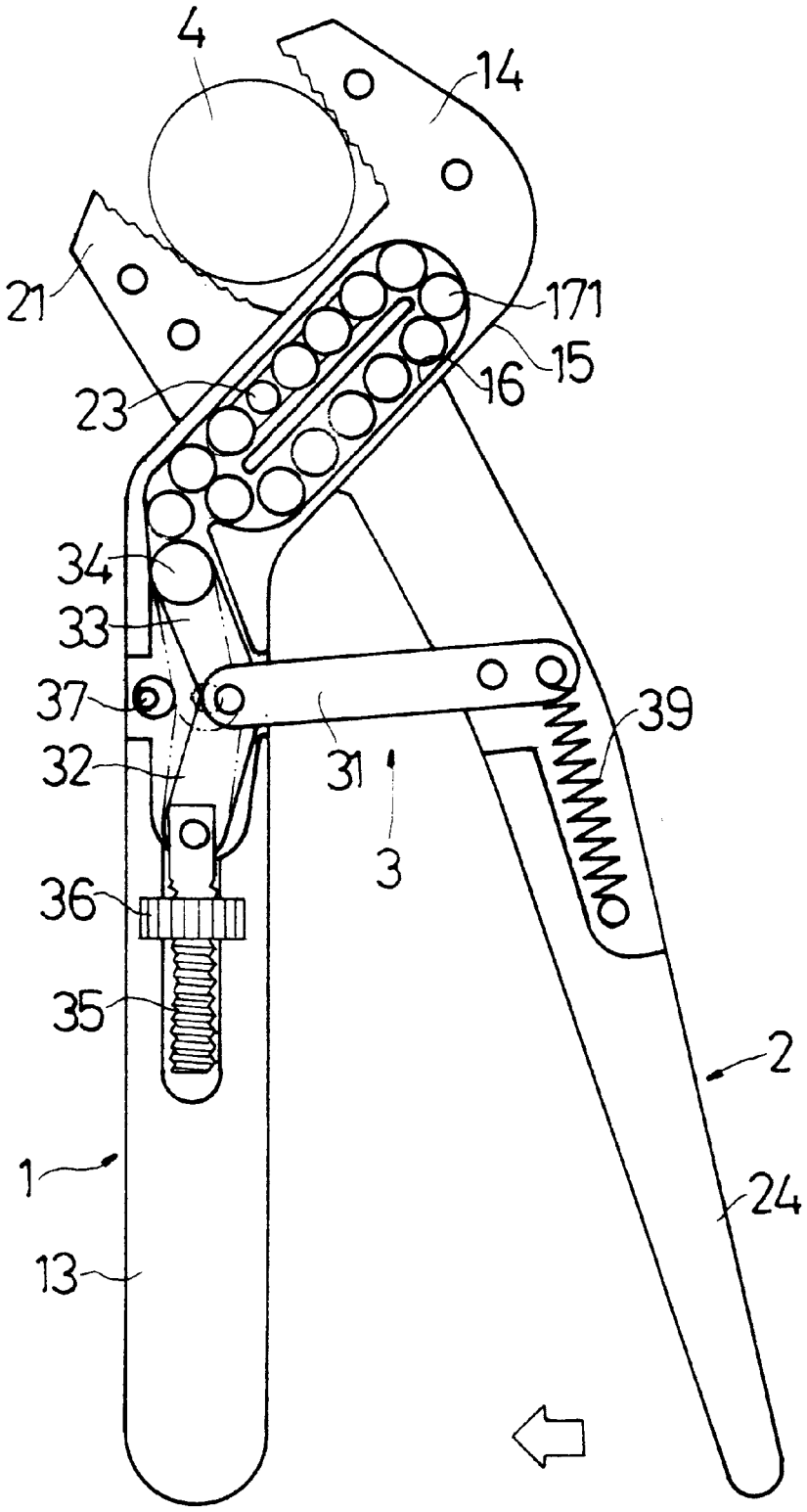
FIG. 4 is a side view of the first embodiment, showing that the fixed jaw and movable jaw clamp a work piece but the elbow mechanism is not fixed.
Figure 5:
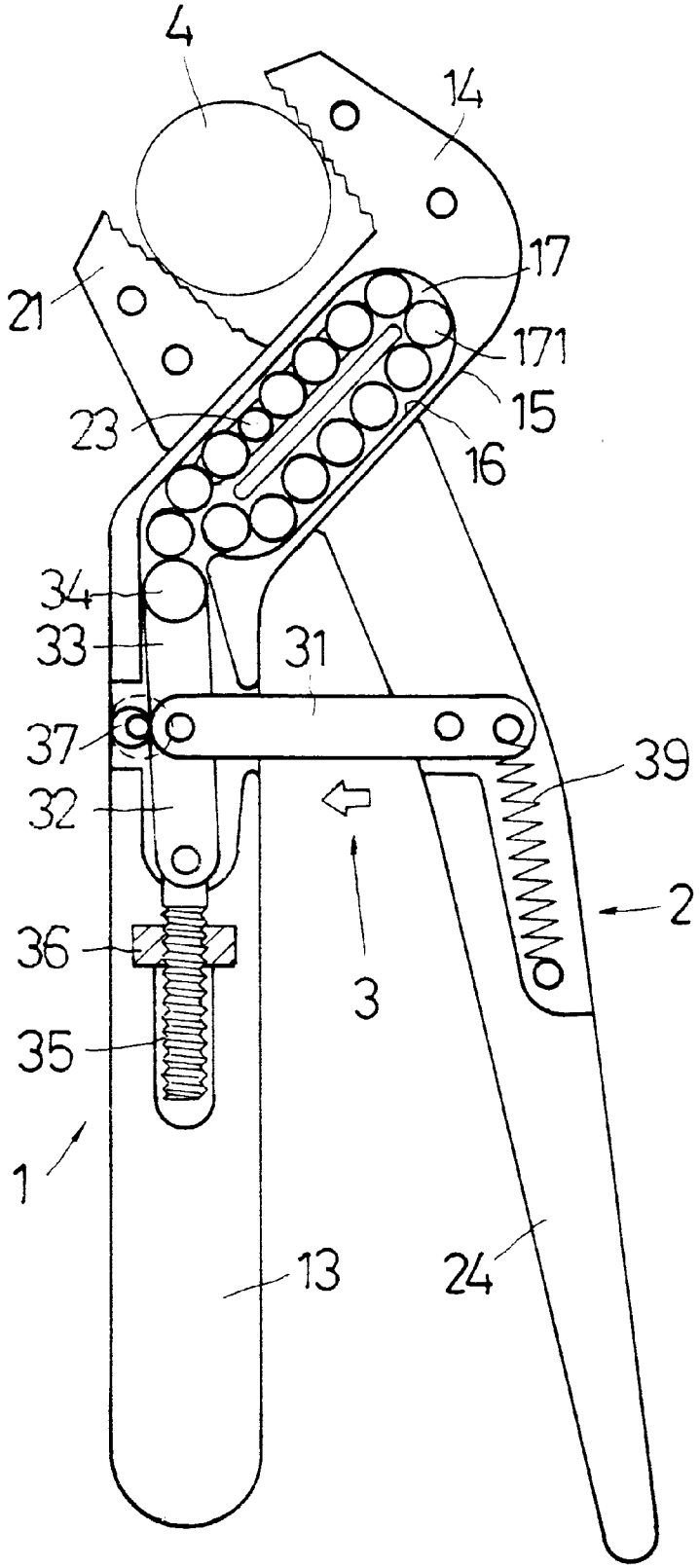
FIG. 5 is a side view of the first embodiment, showing that the fixed jaw and movable jaw clamp a work piece and the elbow mechanism is fixed.

Please refer to FIGS. 3 to 5. In use of the present invention, first the movable handle 24 is opened from the fixed handle 13. The pushing rod 23 of the movable component 2 downward pushes the rolling balls 171 which move along the moving recess 16 so as to smoothly open the movable jaw 21 from the fixed jaw 14. When it is desired to tightly clamp the work piece 4, the user can grip the fixed handle 13 and the movable handle 24. The spring 39 pulls the first lever 31 of the elbow mechanism 3, so that at the beginning of gripping, the first lever 31 will not directly abut against the second and third levers 32, 33. Accordingly, the pushing rod 23 pushes back the rolling balls 171 and shortens the distance between the fixed jaw 14 and the movable jaw 21 so as to clamp the work piece 4. At this time, the movable jaw 21 can be still opened from the fixed jaw 14. However, when the user further presses the movable handle 24 toward the fixed handle 13, the movable handle 24 will press the first lever 31 of the elbow mechanism 3. The first lever 31 then pushes the second and third levers 32, 33 to stretch straight the same, whereby the second and third levers 32, 33 create an upward straight pushing force. At this time, the engaging member 34 at the top end of the third lever 33 upward tightly abuts against the rolling balls 171 in the moving recess 16 without pitch limitation. After the rolling balls 171 are tightly engaged, the moving of the pushing rod 23 is limited and the distance between the fixed jaw 14 and the movable jaw 21 is fixed so that the work piece 4 is tightly clamped.

After the elbow mechanism 3 is fixed, the user can hardly open the movable handle 24 from the fixed handle 13 with one single hand. When it is desired to easily open the pincers with one hand, the user must first rotate the rotary switch 38 to make the eccentrical section of the cam 37 abut against the pivot section of the second and third levers 32, 33. By means of the pulling force of the spring 39 onto the first lever 31, the user can open the movable handle 24 from the fixed handle 13 with one hand and pull away the first lever 31. Therefore, the engaging member 34 of the third lever 33 no more abuts against the rolling balls 171, permitting the the rolling balls 171 to move within the moving recess 16. Therefore, the distance between the fixed jaw 14 and the movable jaw 21 can be elongated. In addition, the thread rod 35 is moved by the adjustment switch 36 to change the pressing force of the elbow mechanism 3 onto the moving member 17 and eliminate the gaps between the rolling balls 171 so as to adjust the clamping force of the fixed jaw 14 and the movable jaw 21. At this time, the elbow mechanism 3 will not exert a resistant force against the movable handle 24 so that the pincers can be used without consuming much strength.

According to the above arrangement, with the cam 37, the pincers of the present invention can be operated with one hand, permitting the other hand to hold other articles so as to facilitate operation. Moreover, the moving travel of the pincers can be adjusted pitchlessly. The moving member 17 alternatively can be a belt, chain, etc.

Figure 6:
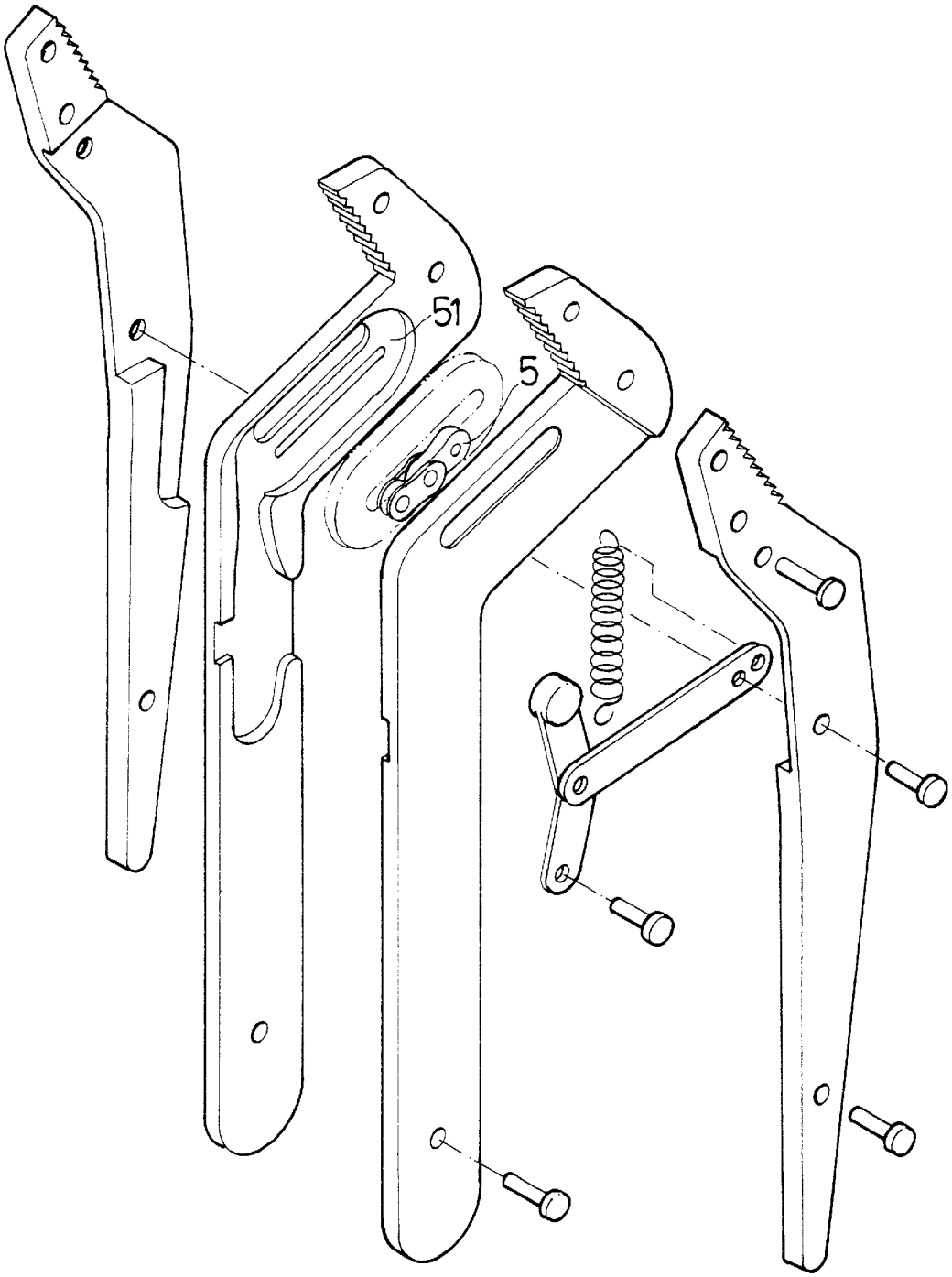
FIG. 6 is a perspective disassembled view of a second embodiment of the present invention.

FIG. 6 shows a second embodiment of the present invention, in which the moving member 5 is a flexible transmission member 5 such as a chain which is smoothly pitchlessly movable within the moving recess 51 so as to achieve the same pitchless adjustment as the first embodiment.

Figure 7:
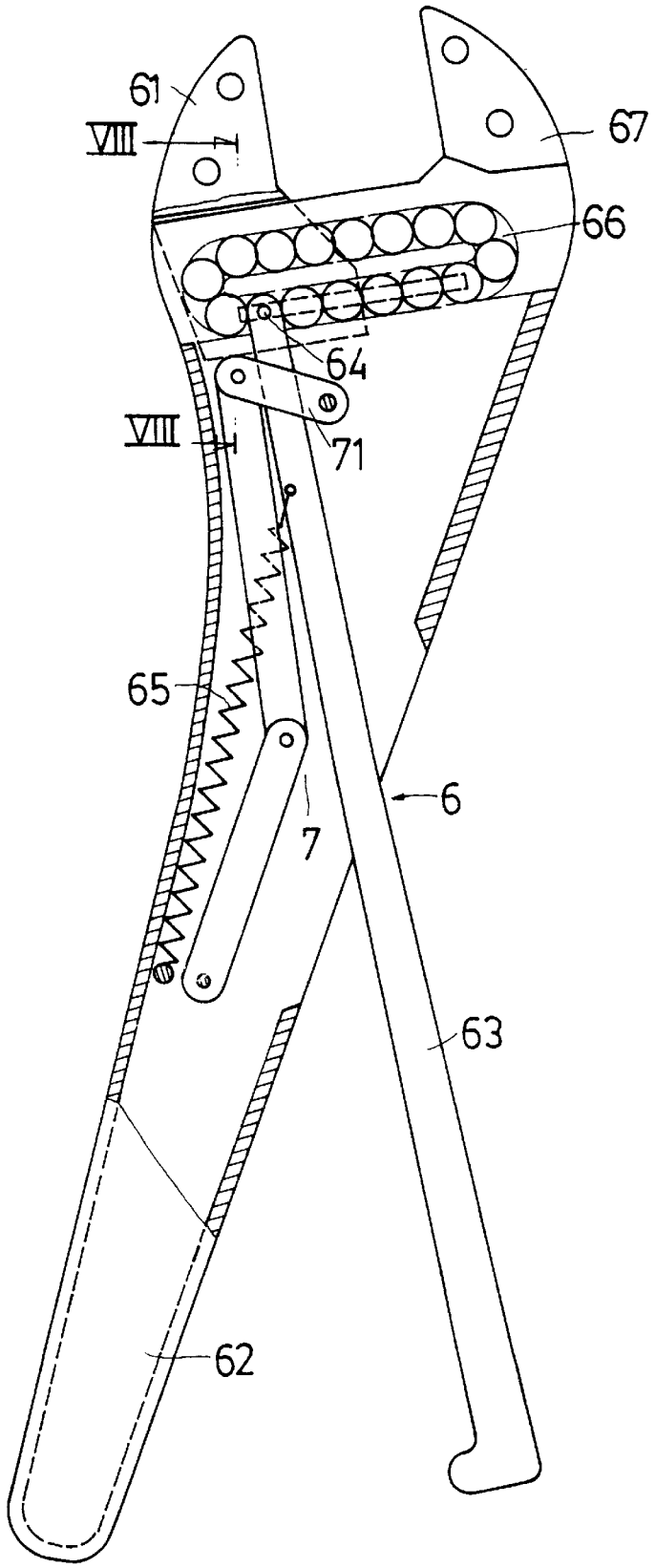
FIG. 7 is a side view of a third embodiment of the present invention.
Figure 8:
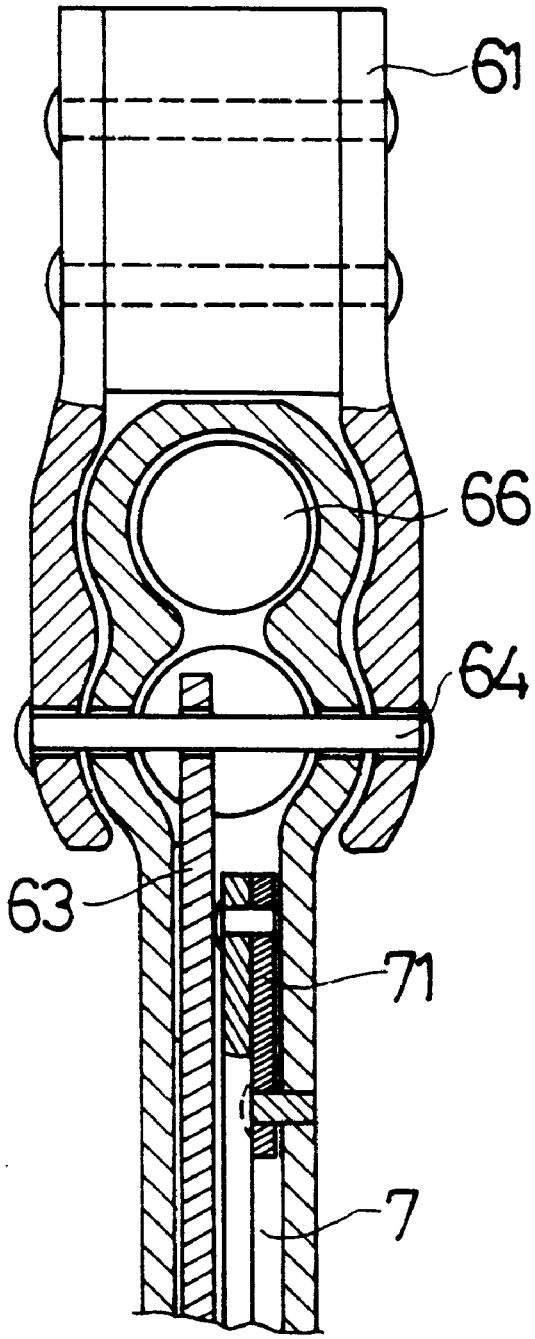
FIG. 8 is a sectional view taken along line VIII—VIII of FIG. 7.
Figure 9:
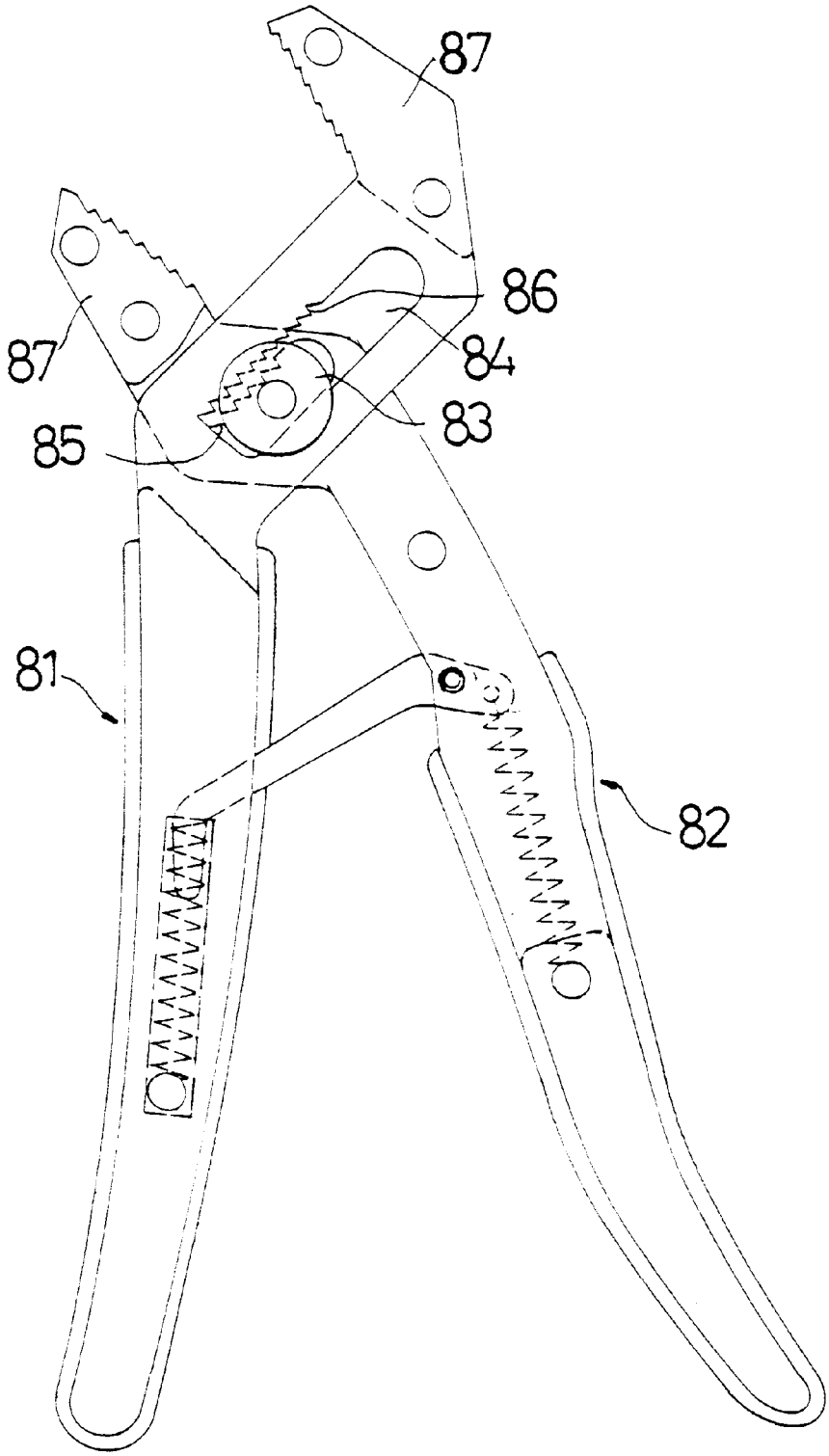
FIG. 9 PRIOR ART
FIG. 9 is a side view of a conventional pincers.
Figure 10:
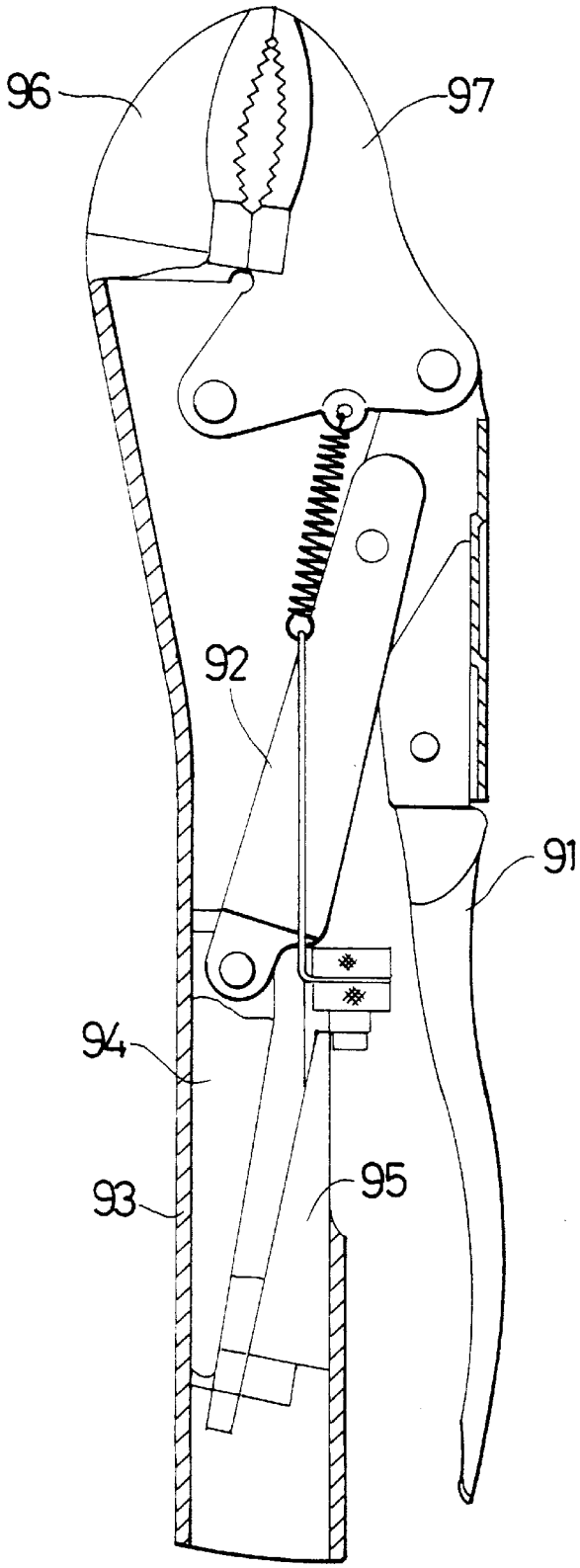
FIG. 10 PRIOR ART
FIG. 10 is a sectional view of another type of conventional pincers.

FIGS. 7 and 8 show a third embodiment of the present invention, which is a movable wrench. The bottom end of the movable jaw 61 of the movable handle 6 encloses the fixed handle 62. An upper end of the movable handle 63 of the movable component 6 is connected with the pushing rod 64 of the movable jaw 61. An upper section of the movable handle 63 is positioned in the fixed handle 62 and connected with one end of a spring 65. The other end of the spring 65 is connected with the fixed handle 62. An elbow mechanism 7 is disposed in the fixed handle 62. An upper end of the elbow mechanism 7 is connected with one end of an engaging lever 71. The other end of the engaging lever 71 is pivotally connected with the fixed handle 62. The movable handle 63 drives the movable jaw 61 and abuts against the elbow mechanism 7 to stretch straight the same. Also, the pushing rod 64 is deflected to abut against the moving member 66 so as to fix the distance between the movable jaw 61 and the fixed jaw 67.

It is to be understood that the above description and drawings are only used for illustrating some embodiments of the present invention, not intended to limit the scope thereof. Any variation and derivation from the above description and drawings should be included in the scope of the present invention.

What is claimed is:

1. A pincers comprising:

a fixed component a lower end of which is disposed with a fixed handle, an upper end of the fixed component being disposed with a fixed jaw connected to the fixed handle by an interconnecting section, an inner face of the interconnecting section being formed with an elliptic moving recess, at least one moving member being disposed in the moving recess, an upper section of the moving recess being formed with a slide slot with the same inclination angle as that of the interconnecting section;

a movable component an upper end of which is disposed with a movable jaw abutting against the fixed jaw of the fixed component, a bottom of the movable jaw being formed with a passage through which the interconnecting section of the fixed component is passed, the movable component at the passage being disposed with a pushing rod passing through the slide slot of the interconnecting section and connected with the moving member, a lower section of the movable component being disposed with a movable handle; and a locating mechanism disposed on one side of the moving recess of the fixed component for fixing the moving member and restricting the moving of the pushing rod as to fix the distance between the fixed jaw and the movable jaw.

2. A pincers as claimed in claim 1, wherein the fixed component is composed of a first and a second panel opposite to each other and the movable component is composed of two panels.

3. A pincers as claimed in claim 1, wherein the locating mechanism is an elbow mechanism disposed between the fixed handle and the movable handle, the elbow mechanism including a first lever, one end of the first lever being pivotally connected with the movable handle, the other end of the first lever being pivotally connected with an upper end of a second lever and a lower end of a third lever, a lower end of the second lever being pivotally connected with the fixed handle, an upper end of the third lever being connected with an engaging member.

4. A pincers as claimed in claim 1, wherein the moving member is composed of multiple rolling balls.

5. A pincers as claimed in claim 1, wherein a receptacle downward extends from a bottom of upper section of the moving recess of the fixed component for receiving an engaging member.

6. A pincers as claimed in claim 1, wherein the moving member is an endless chain.

* * * * *